United States Patent [19]

Hestehave et al.

[11] Patent Number: 4,541,529

[45] Date of Patent: Sep. 17, 1985

[54] BLOW MOLDED CONTAINER AND SUPPLEMENTAL HANDLE THEREFOR

[75] Inventors: Borge Hestehave, Alta Loma; Kjeld Hestehave, Upland, both of Calif.

[73] Assignee: Bomatic, Inc., Ontario, Calif.

[21] Appl. No.: 515,173

[22] Filed: Jul. 19, 1983

[51] Int. Cl.[4] ..... B65D 21/02; B65D 25/28

[52] U.S. Cl. ..... 206/510; 206/509; 206/511; 215/10; 220/94 R; 220/94 A; 222/143; 16/111 R; 16/DIG. 12

[58] Field of Search ..... 206/509, 510, 511, 512, 206/499; 222/143; 215/10, 100 A; 220/94 R, 94 A, 95; 16/111 R, 114 R, DIG. 12, DIG. 24

[56] References Cited

U.S. PATENT DOCUMENTS

| | | | |
|---|---|---|---|
| 1,268,775 | 6/1918 | Stanger | 220/75 |
| 2,387,270 | 10/1945 | Johnson | 206/510 |
| 2,512,105 | 6/1950 | Kooij | 220/94 A |
| 2,664,105 | 12/1944 | Socke | 16/DIG. 12 |
| 3,250,434 | 5/1966 | Howlett | 222/143 |
| 3,744,656 | 7/1973 | Schiemann | 215/100 A |
| 3,746,200 | 7/1973 | Flider | 215/10 |
| 3,765,574 | 10/1973 | Urquiza | 222/143 |
| 3,831,817 | 8/1974 | Leccese | 222/143 |

FOREIGN PATENT DOCUMENTS

| | | | |
|---|---|---|---|
| 1147167 | 4/1963 | Fed. Rep. of Germany | 220/94 R |
| 1172600 | 6/1964 | Fed. Rep. of Germany | 222/143 |
| 3139083 | 12/1982 | Fed. Rep. of Germany | 206/499 |

*Primary Examiner*—George E. Lowrance

*Attorney, Agent, or Firm*—Sixbey, Friedman & Leedom

[57] ABSTRACT

A stackable plastic container has a unitarily formed handle on a top surface thereof. In accordance with a first feature, the top wall is provided with a pair of upwardly projecting portions that are asymmetrically disposed relative to a center line extending across the container and between which the handle extends. The bottom portion is provided with supporting and stacking nubs that are situated at positions corresponding to the projecting top wall portions, and the top wall portions have nub-receiving stacking recesses positioned on opposite sides of the handle so as to enable stacking of a like container on the container by engagement of supporting and stacking nubs of the like container in the stacking recesses of the container. According to a second aspect of the invention, a supplemental handle is provided which may be detachably attached to the container handle so as to convert the container from a single handle container to a triple-handle container, complying with military specifications for Jerry-type cans.

17 Claims, 9 Drawing Figures

BLOW MOLDED CONTAINER AND SUPPLEMENTAL HANDLE THEREFOR

BACKGROUND AND SUMMARY OF THE INVENTION

The present invention relates to containers of the type used to store flammable liquids, and, in particular, to a container of the type known as a "Jerry Can".

Containers for flammable liquids have to meet prescribed governmental saftey specifications and, in the case of Jerry Cans for use by the armed forces, military specifications must be met as well. These military specifications, for the most part, are based upon the original metal containers of this type (see U.S. Pat. No. 2,387,270) developed during World War II. Among these specifications is the fact that they must be able to stack neatly and stably one upon another, as well as fit together side-by-side and front-to-back. Additionally, due to the fact that a conventional 5-gallon Jerry Can, filled with gasoline, is extremely heavy, military specifications require a triple-handle having three parallel handle bars, a central one of the bars being utilized by a single individual to carry the container thereby, and the two outer handles being utilized so as to enable three containers to be carried by two individuals, with one of the containers being held by a respective one of its outer handles by each of the two individuals. This triple-handle requirement, while unnecessary with the advent of lighter, blow molded plastic containers, applies irrespective of the material that the container is formed of.

U.S. Pat. No. 3,746,200 discloses a blow molded plastic Jerry Can that has been developed to meet military specifications for Jerry Cans. In order to meet the triple-handle military requirements (in view of the difficulties in blow molding a container with a satisfactory, unitary triple-handle), in accordance with the disclosure of this patent, the plastic container is blow molded with a single, unitarily formed, bar-type handle extending centrally along the top of the container, with ridges being formed projecting upwardly from opposite ends of the handle, and with a fin projecting from the top surface of the container, parallel and spaced below the handle. An injection molded, plastic supplemental handle is then placed on top of the container so as to flank both sides of the central handle and is permanently attached to the container by rivets, which interconnect the supplemental handle to each of the upwardly projecting ridges of the central handle and to several locations along the upwardly projecting fin of the container top wall.

For purposes of enabling stacking of the above-noted plastic Jerry Can upon a like Jerry Can, the can of U.S. Pat. No. 3,746,200 is provided with a recessed bottom wall that is contoured to receive the handle with its upwardly projecting ridges, and a middle pair of six feet that are provided on a non-recessed portion of the bottom wall are provided with a cleated formation for engaging in complementarily shaped recesses in each of the handle bars of the supplemental handle.

While such a plastic Jerry Can possesses advantages over the old sheet metal Jerry Cans, since such a can requires the use of complexly shaped molds and additional operations for riveting of the supplemental handle to the container, such a container is significantly more expensive to produce than a conventional blow molded container. Furthermore, since the container is specifically designed so that the supplemental handle is a permanently attached part thereof, and since its stacking capacity is dependent upon the presence of the supplemental handle, the container of U.S Pat. No. 3,746,200 is not usable without the supplemental handle, so that the same container cannot be sold as a less costly single handle stackable container version to the general public, as well as the military as a triple-handle Jerry Can. In this regard, it is noted that, while the triple-handle is required for compliance with military specifications, such is not a desirable characteristic for use on a commercial container, since the outer handles (which are seldom utilized on such a plastic container) not only increase the cost, and, thus, the selling price, of such a container, but also make use of the central handle less convenient.

It is, thus, an object of the present invention to provide a single handle stackable container that can be produced at low cost and without the use of complex molds or assembly operations.

It is a further object of the present invention to produce a container in accordance with the preceding object that can be selectively utilized with or without a supplemental handle that is able to convert the single handle into a triple-handle complying with military specifications for Jerry Cans.

With regard to the former object, it is noted that stackable, single handle containers are known, such as that of U.S. Pat. No. 3,214,052, but such stackable containers normally require a recessing of the bottom wall of the container in order to accommodate the top handle of the container, thereby requiring an increase in the overall sizes of the container in order for it to accommodate a given capacity, and also requiring more complex blow molds and molding operations, both of which contribute to an increase in the cost of the container.

With regard to the second of the above-noted objects, it is noted that detachable handles for fuel containers have been known from patents such as U.S. Pat. No. 2,288,359, but such detachable, supplemental handles are not suitable for use in converting a single handle into a triple-handle, which would comply with U.S. military specifications for Jerry-type cans, and, in fact, do not modify the integral handle of the container, at all. Likewise, U.S. Pat. No. 3,115,229 discloses a handle which is convertible from a single bar handle to a dual-bar handle, and U.S. Pat. No. 2,364,105 discloses a snap-on handle grip for a single handle of a container, but neither of these arrangements are suitable for achieving either of the above-noted objects.

On the other hand, the present invention is able to fully achieve the above-noted objects through the provision of a stackable plastic container having a container body of generally rectangularly configuration having an elongated top wall, a substantially planar, elongated bottom wall, a pair of major side walls, and a pair of minor side walls. The top wall is provided with a threaded neck-like opening in the vicinity of one of the pairs of minor side walls and a pair of upwardly projecting top wall portions that are asymmetrically disposed relative to a center line extending across the container between the major side walls. A first of these top wall portions substantially spans the distance between the pair of major side walls in the vicinity of the other of the minor side walls, and the second of the top wall portions substantially spans the distance between the pair of major side walls at a position adjacent the neck-like opening. A single bar-type handle extends, as a unitary part of the container situated centrally between the pair of major side walls, from the first of the top wall portions to the second of the top wall portions, so that a hand opening is formed underneath the unitary handle, between the projecting top wall portion. The bottom wall is provided with a plurality of downwardly projecting stacking nubs that are situated at positions corresponding to the projecting top wall portions and the projecting top wall portions have nub receiving stacking recesses positioned on opposite sides of the handle for enabling stacking of a like container on the container by engagement of the supporting and stacking nubs of the like container in the stacking recesses of the container.

Such a configuration produces a container that is easy to manufacture by conventional blow molding techniques, is easily grasped, and is stably stackable without the container having to be configured with capaacity reducing recessed bottom wall portions for accommodation of the handle.

Furthermore, in order to enable this same container to be brought into compliance with military specifications for Jerry-type cans, the present invention also comprises a rigid supplemental handle that is sized and shaped for insertion into the hand opening of the container and for detachable engagement with the unitary handle bar of the container top wall. In particular, in accordance with a preferred embodiment, the supplemental handle has a pair of bar-type handle portions which, when the supplemental handle is engaged with the unitary handle of the container top wall, are disposed parallel thereto on opposite sides thereof, thereby converting the single handle container into a triple-handle container of the type required for military Jerry Cans. Preferably, the handle portions of the supplemental handle are interconnected at its opposite ends by crosspieces which have a centrally positioned notch therein for engagingly receiving the unitary handle of the container top wall, the notches of the crosspieces having nub-like detents at upper edges thereof for detachably securing the supplemental handle to the handle of the container top wall.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
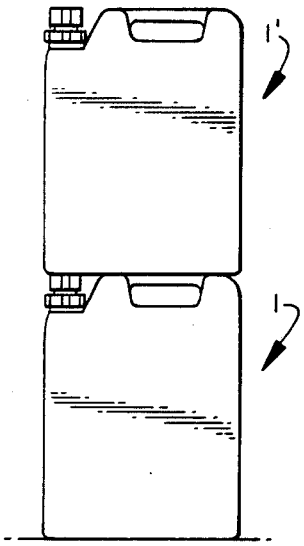
FIG. 1 is a side elevational view showing a pair of containers, in accordance with the present invention, stacked one upon the other.

The stackable container 1, as can be readily seen from the drawings, is of a generally rectanguloid configuration having a pair of major side walls 2, 3, a pair of minor side walls 4, 5, an elongated bottom wall 6, and an elongated top wall, indicated generally at 7.

The body of the container 1 is preferably formed entirely of blow molded plastic, in such a manner that the top wall 7 is unitarily formed with an internally threaded, neck-like opening 8, a pair of upwardly projecting top wall portions 9, 10, and a single, bar-type handle 11, while the bottom wall is substantially planar, except for the provision of a plurality of downwardly projecting, unitary supporting and stacking nubs 12 and additional supporting nubs 13.

The neck-like opening 8 is situated in the vicinity of the minor side wall 4, and located adjacent to an opposite side of the neck opening 8 is a first of the upwardly projecting portions 9 of the top wall 7. As can be seen from FIG. 2, the upwardly projecting top wall portion 9 substantially spans the distance between the pair of major side walls 2, 3, as does the second of the projecting top wall portions 10, that is disposed in the vicinity of the other of the minor side walls 5. These upwardly projecting top wall portions are asymmetrically disposed relative to a center line CL extending across the container between the major side walls, and the bar-type handle 11 extends from the first top wall portion 9 to the second top wall portion 10 at a position situated centrally between the pair of major side walls 2, 3. A central portion of the top wall 14 extends across the top wall 7, between the projecting top wall portions 9, 10, at a position below the handle 11 so that a hand opening is formed between the handle bar 11 and the central wall portion 14, whereby the container can be easily grasped for carrying the container in one hand.

The unitary supporting and stacking nubs 12 on the bottom wall 6 of the container 1 are situated at positions corresponding to the top wall portions 9, 10, and the top wall portions have nub-receiving stacking recesses 15 positioned on opposite sides of the handle for enabling a like container 1' (FIG. 1) to be stacked upon the container 1, in a stable manner, by engagement of the supporting and stacking nubs of the like container in the stacking recesses 15. A configuration for the stacking nubs and recesses that has been found suitable and easy to form during blow molding of the container is the spheric shape shown on the illustrated preferred embodiment. However, other shapes can be utilized.

Likewise, while the additional pair of supporting nubs 13, which are utilized on conjunction with the nubs 12 for supporting the container in an unstacked condition on a floor or the like, are shown of the same spheric shape as the supporting and stacking nubs 12, since they are not utilized for stacking purposes, they not only do not have to be spheric in shape, but they do not even have to be of the same shape as the nubs 12. On the other hand, it is necesssry that the additional nubs 13 be of the same height, relative to the bottom of the container, as the nubs 12 and they must be sized and situated so as not to interfere with stacking of the container on another container, such as by contacting the top of the threaded closure 16 utilized to seal the neck-like opening 8. For this reason, a pair of nubs is shown situated at opposite sides of the neck-like opening in such a manner as not to engage against the container or the closure.

In this regard, it is particularly advantageous to utilize, instead of the typical bung-type closure found on conventional Jerry Cans, a dual cap that is comprised of a large diameter cap 17 that is threaded for engaging with the threading of the neck-like opening 8 of the container 1 and which has a concentrically disposed aperture therethrough, and a small diameter closure cap 18 for sealingly engaging with a neck-like projection of the large diameter cap, which defines the upper end of the aperture through the large diameter cap, such as by the provision of mutually engageable threads on the inside of the small cap 18 and the outside of the neck-like projection of the large diameter cap 17. Such caps are, per se, known, and, as such, forms no part of the present invention, apart from its dimensioning for cooperation with the other described aspects of the container of the present invention.

On the other hand, it is particularly advantageous if the threaded closure 16 has a height which, when the closure is fully threaded to the neck-like opening 8, will have a top portion, such as the top of ribs formed on the small cap 18 for purposes of facilitating grasping and turning thereof, in a common plane with a top surface of each of the top wall portions 9, 10, so that the top portion of the closure 16 will supportingly engage the planar portion of the bottom wall 6 of like container 1', between the additional nubs 13 thereof.

Figure 2:
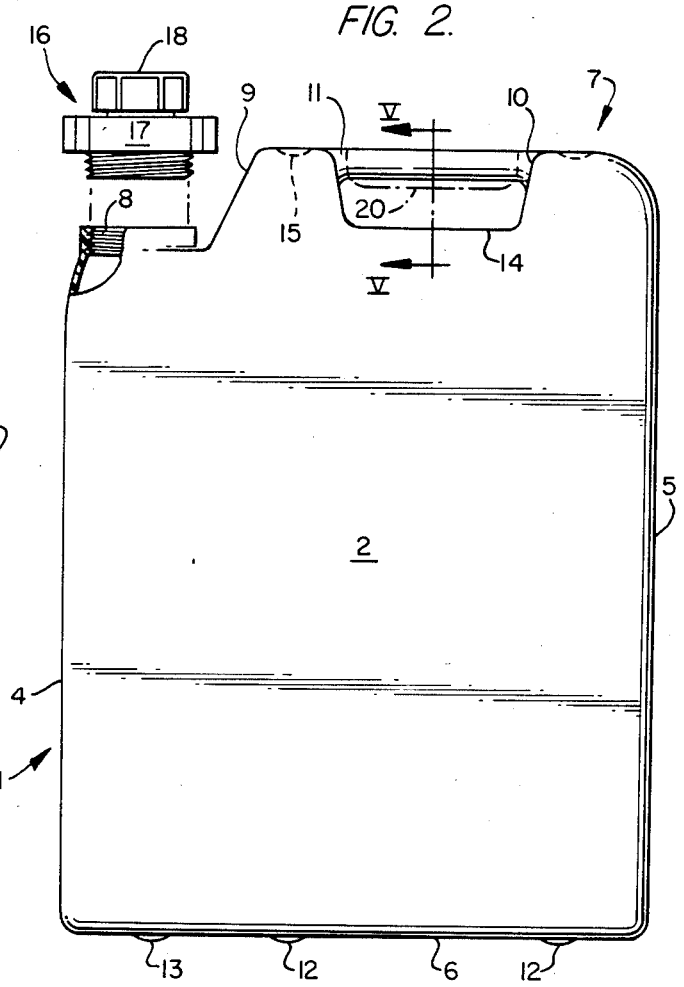
FIG. 2 is a partially exploded, partial sectional view of one of the like containers shown in FIG. 1.
Figure 3:
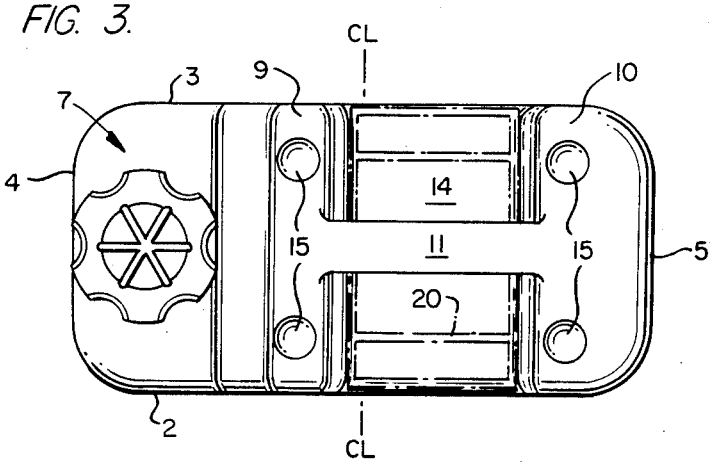
FIG. 3 is a top plan view of the container of FIG. 2.
Figure 4:
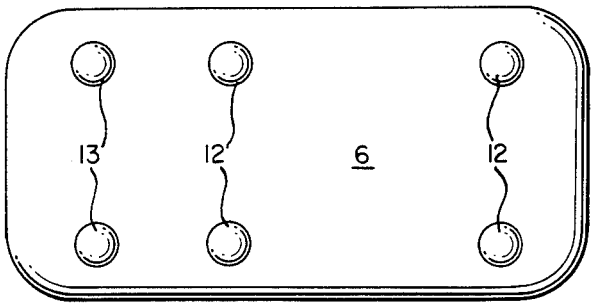
FIG. 4 is a bottom plan view of the container of FIG. 2.
Figure 5:
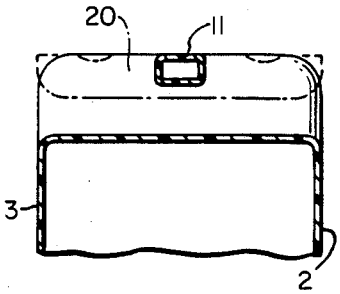
FIG. 5 is a sectional view taken along line V—V of FIG. 2.
Figure 6:
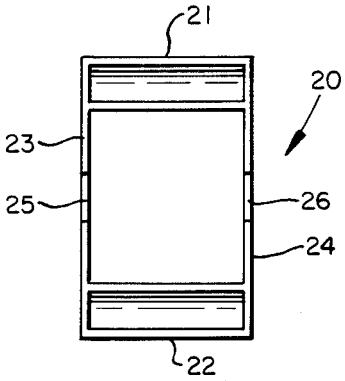
FIG. 6 is a top plan view of a supplemental handle.
Figure 7:
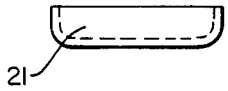
FIG. 7 is an end view of the supplemental handle of FIG. 6.
Figure 8:
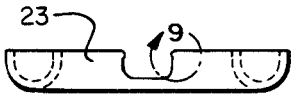
FIG. 8 is a side view of the supplemental handle of FIG. 6.

As mentioned previously, in order to meet military specifications for Jerry Can type containers, a container must have a triple-handle by way of which the container may be carried by a single person or by a respective hand of two individuals. Thus, to enable the above-described container to meet military specifications, a rigid supplemental handle 20 is provided. Handle 20 is preferably formed of a plastic material by injection molding. The supplemental handle 20 is represented in FIGS. 2, 3 and 5 by a broken dot-dash line. As can be seen from these figures, the handle is sized and shaped for insertion into the hand opening, below the bar-type handle 11, and movement up into engagement therewith, so that the upper surface of the handle is in a substantially common plane with the top of handle 11 and top wall portions 9, 10, and its lower wall is spaced above central wall portion 14.

Figure 9:
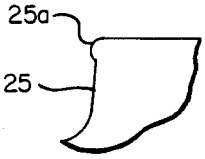
FIG. 9 is an exploded view of detail area 9 of FIG. 8.

The supplemental handle 10 has a pair of bar-type handle portions 21, 22 that are interconnected, at each of opposite ends thereof, by a pair of crosspieces 23, 24. Each of the crosspieces has a centrally positioned notch 25, 26 within which the handle 11 is engagingly received in the position shown in FIGS. 2 and 5. In order to secure the supplemental handle 20 to the container handle 11, so that the supplemental handle will not become unintentionally disengaged therefrom, the upper edges of the notches are provided with rounded nub-like detents. FIG. 9 shows one of the two nub-like detents 25*a* of the notch 25 in crosspiece 23. While the supplemental handle 20 is rigid and, thus, the walls of the notches 25, 26 will not flex away from each other during engagement of the supplemental handle 20 with the container handle 11, the material of the blow molded container handle is of a semi-rigid nature, so that it can flex inwardly, as it is passed between the nubs, and then resume its original shape thereafter. Should it be subsequently desired to remove the supplemental handle, such can be easily done by merely pulling or pressing down on the handle portions 21, 22.

By way of example, it is noted that, for a 5-gallon Jerry Can, as illustrated, a handle 11 of approximately 1 inch width and approximately 182 inch thickness can adequately sustain the load exerted when the container, in a fully filled condition, is carried by the supplemental handle. It is also noted that securement of the supplemental handle 20 to the container handle 11 can be further facilitated if the handle is provided with an approximately ¼ inch radius curvature at its upper edges and its side walls taper inwardly in a downward direction at an angle of about 5° from vertical. In this manner, the side walls of the handle can more easily pass between the nub-like detents of the supplemental handle, and the nub-like detents can be retained upon the rounded upper edges of the handle.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A stackable plastic container comprising: a blow molded container body of generally rectanguloid configuration having elongated top and bottom walls, a pair of major side walls and a pair of minor side walls;

wherein said top wall is provided with a threaded neck-like opening, in the vicinity of one of said pair of minor side walls and centrally positioned relative to said major side walls, a pair of upwardly projecting top wall portions of the blow molded container body that are symmetrically disposed relative to a center line extending across the container between said major side walls, a first of said top wall portions substantially spanning between said pair of major side walls at a position adjacent said neck-like opening, a second or said top wall portions substantially spanning between said pair of major side walls in the vicinity of the other of said minor side walls and at the same height as the first portion, and a single bar-type handle extending, as a unitary part of said container situated centrally between said pair of major side walls, from said first top wall portion to said second top wall portion, and a central portion extending across said top wall, between said projecting top wall portions, at a position below said handle so as to form a hand opening;

wherein said bottom wall is substantially planar except for the provision of a plurality of downwardly projecting, unitary supporting and stacking nubs, said nubs being situated at positions corresponding to said projecting top wall portion; and wherein said to wall portions have nub receiving stacking recesses positioned on opposite sides of said handle for enabling stacking of a like container on said container by engagement of the supporting and stacking nubs of the like container in said stacking recesses;

further comprising a rigid supplemental handle means sized and shaped for insertion through said hand opening and for detechable engagement with said single, bar-type handle of the container top wall, said supplemental handle means having a pair of bar-type handle portions laterally spaced from each other and connected by crosspieces, notch means in the crosspieces for receiving said bar-type handle of the container top wall, and securing means for retaining the bar-type handle of the container within the notch means, whereby the container is convertible from a single handle container to a triple handle container.

2. A stackable plastic container according to claim 1, further comprising a threaded closure for said sealing the neck-like opening, and wherein said bottom wall is provided with additional nubs for supporting said container, said additional nubs being situated at positions corresponding to laterally opposite sides of said neck-like opening in a manner that the additional nubs of said like container stacked on the container will not engage against the container or said closure.

3. A stackable plastic container according to claim 2, wherein said threaded closure has a height which, when said closure is fully threaded to said neck-like opening, will have a top portion thereof in a common plane with a top surface of each of said top wall portions, whereby the top portion of the closure will supportingly engage a planar portion of the bottom wall of said like container between the additional nubs thereof.

4. A stackable plastic container according to claim 3, wherein said closure is a dual cap having a large diameter cap that is threaded for engaging with the threading of the neck-like opening of the container and which has a concentrically disposed aperture therethrough, and a small diameter closure cap for sealingly engaging with a neck-like projection of the large diameter cap which defines the upper end of said aperture through the large diameter cap.

5. A stackable plastic container according to claim 3, wherein said nubs, additional nubs and stacking recesses are spheric in shape.

6. A stackable plastic container according to claim 1, wherein said nubs, additional nubs and stacking recesses are spheric in shape.

7. A stackable plastic container according to claim 1, wherein the handle portions of the supplemental handle means are interconnected at each of opposite ends thereof by said crosspieces, and wherein said notch means comprises a centrally positioned notch in each of said crosspieces for engagingly receiving the bar-type handle of the container top wall.

8. A stackable plastic container according to claim 7, wherein, as said securing means the notches of the crosspieces have nub-like detents at upper edges thereof for detachably securing the supplemental handle means to the handle of the container top wall.

9. A stackable plastic container according to claim 8, wherein the body of said container is formed entirely of blow molded plastic and the supplemental handle means is formed of injection molded plastic.

10. A plastic container comprising: a container body having walls defining a receiving space and an opening for filling and emptying thereof;

wherein a top wall is provided with a pair of spaced upwardly projecting top wall portions, a single bar-type handle extending centrally, as a unitary part of said container, from a first of said top wall portions to a second of said top wall portions, and a central portion extending across said top wall, between said projecting top wall portions, at a position below said handle so as to form a hand opening; and wherein a rigid supplemental handle means is provided that is sized and shaped for insertion through said hand opening and for detachable engagement with said single, bar-type handle of the container top wall, said supplemental handle means having a pair of bar-type handle portions, laterally spaced from each other and interconnected by crosspieces, notch means in the crosspieces for receiving the unitary central handle, and securing means for retaining the unitary handle within the notch means, whereby the container is convertible from a single handle container to a triple handle container.

11. A stackable plastic container according to claim 10, wherein the handle portions of the supplemental handle means are interconnected at each of opposite ends thereof by said crosspieces, and wherein said notch means comprises a centrally positioned notch in each of said crosspieces for engagingly receiving the bar-type handle of the container top wall.

12. A stackable plastic container according to claim 11, wherein, as said securing means the notches of the crosspieces have nub-like detents at upper edges thereof for detachably securing the supplemental handle means to the handle of the container top wall.

13. A stackable plastic container according to claim 12, wherein the body of said container is formed entirely of blow molded plastic and the supplemental handle means is formed of injection molded plastic.

14. A container comprising a container body having walls defining a receiving space; an opening for filling and emptying of said receiving space, a single bar-type handle secured to a top wall of said container in a manner forming a hand opening between said handle and top wall; and a rigid supplemental handle means sized and shaped for insertion through said hand opening and for detachable engagement with said single, bar-type handle of the container top wall, said supplemental handle means having a pair of bar-type handle portions laterally spaced from each other and interconnected by crosspieces, notch means in the crosspieces for receiving said bar-type handle of the container top wall, and securing means for retaining the bar-type handle of the container within the notch means, whereby the container is convertible from a single handle container to a triple handle container.

15. A stackable plastic container according to claim 15, wherein the handle portions of the supplemental handle means are interconnected at each of opposite ends thereof of said crosspieces, wherein said notch means comprises a centrally positioned notch in each of said crosspieces for engagingly receiving the bar-type handle of the container top wall.

16. A stackable plastic container according to claim 15, wherein, as said securing means the notches of the crosspieces have nub-like detents at upper edges thereof for detachably securing the supplemental handle means to the handle of the container top wall.

17. A stackable plastic container according to claim 16, wherein the body of said container is formed entirely of blow molded plastic and the supplemental handle means is formed of injection molded plastic.

* * * * *